United States Patent [19]

Kintz

[11] Patent Number: 4,553,750

[45] Date of Patent: Nov. 19, 1985

[54] RACK ATTACHMENT FOR GAME TABLES

[76] Inventor: Glenn W. Kintz, 3306 Ammon Way, Forest Grove, Oreg. 97116

[21] Appl. No.: 530,221

[22] Filed: Sep. 8, 1983

[51] Int. Cl.[4] ..... A63D 15/00

[52] U.S. Cl. ..... 273/22; 273/46

[58] Field of Search ..... 273/22, 14, 127 D, 392, 273/55 R, 46, 55 B; 272/16, 76, 77, 78

[56] References Cited

U.S. PATENT DOCUMENTS

| | | | |
|---|---|---|---|
| 850,360 | 4/1907 | Flint | 273/22 |
| 1,052,461 | 2/1913 | Chase | 273/22 |
| 1,246,436 | 11/1917 | Kitzeman | 273/22 |
| 1,499,407 | 7/1924 | Savoie | 273/22 |
| 3,439,916 | 4/1969 | Kopp | 273/55 B |
| 3,927,879 | 12/1975 | Long et al. | 273/55 R |
| 4,239,209 | 12/1980 | Curchod | 272/76 |

*Primary Examiner*—Richard C. Pinkham

*Assistant Examiner*—T. Brown

*Attorney, Agent, or Firm*—Harvey B. Jacobson

[57] ABSTRACT

A table attachment for use in properly locating and orienting a complement of game-playing items, such as pool balls or bowling pins, in required configuration on the playing surface of a table comprises a rack for receiving the complement of items and orienting same into the required configuration, support arms extending from the rack and terminating in ball-shaped ends, and sockets secured to the table surround for releasably and pivotally receiving the ball-shaped ends of the arms. The rack may be swung between a raised inoperative position and a lowered operative position supported on the table surface for racking the playing items. The length of the support arms and location of the sockets accurately positions the rack lengthwise and transversely on the table surface.

16 Claims, 7 Drawing Figures

18
10
30
44
4
48
54
22
34
26
62
36
68
20
70
12
64
50
34
28
52
32
44
4
14

38
40
28

10
18
36
32
44
28
3
12
22

58
52
50
20
34
42
44
3
14
60

12
22
84
68
80
76
70
72
14

48

86

5
80
12
70
82
22
72
76
68
78
74
14
5

RACK ATTACHMENT FOR GAME TABLES

BACKGROUND OF THE INVENTION

This invention relates to apparatus used in playing table games, such as pool or miniature tenpin bowling, where a complement of playing pieces, such as balls in the case of pool, or pins in the case of tenpin bowling, have to be positioned on the table, prior to starting a game, in a particular configuration and at a particular location on the table. In the case of pool, for example, the balls must be located in a triangular configuration near one end of the table, with the head ball situated on a marked spot on the table surface.

It is common practice to position pool balls on a pool table in the required location and configuration by using a portable triangular-shaped frame or rack, which is placed on the table surface with one apex of the rack positioned on the marked spot, and the rack being manually adjusted for angular alignment. The rack is then filled with the balls and removed from the table.

The use of portable racks of the type described is not altogether satisfactory in obtaining accurate placement of the balls, since it relies on a user's sight and judgment of position and alignment. Also, since such racks rest directly on the table, they may eventually wear the expensive cloth coverings used on pool tables, or, if carelessly used, may even damage such coverings.

It is accordingly an object of the present invention to provide a rack structure for use in placing pool balls and the like, which does not suffer the disadvantages inherent in portable racks as described above. More particularly, the invention seeks to provide a rack attachment for a pool table and the like, incorporating locating means providing accurate placement of the rack over the table surface in required position for receipt of pool balls and the like. Other objects of the invention include of provision of a rack structure as described, which can be readily adapted for use on different size tables, which can be easily manipulated, which can be removed from the table when not in use, and which reduces wear and the risk of damage to a table covering.

STATEMENT OF PRIOR ART

The following U.S. patents disclose rack structures for use with pool tables and the like: U.S. Pat. Nos. 850,360, 4/16/07; 1,115,911, 11/3/14; 1,246,436, 11/13/17.

While the structures disclosed in the above patents have certain objects in common with the present invention, they do not provide a combination of features nor all of the advantages afforded by the invention.

SUMMARY OF THE INVENTION

The invention provides a table attachment for accurate placement of game playing pieces, such as pool balls, bowling pins and the like, in required location on the surface of a playing table, the attachment comprising a rack of specified shape for receiving a complement of the game playing pieces and orienting the complement of pieces in required configuration, a support frame extending from the rack, and mounting means for mounting the frame detachably and pivotally on the table surround with the pivot axis of the support frame being situated in a horizontal plane closely corresponding to the plane containing the equators of the playing pieces, thereby allowing the rack to be raised without longitudinal displacement of the playing pieces, the length of the support frame effectively fixing the position of the rack relative to the table in the longitudinal direction, and the location of the mounting means on the table surround effectively fixing the position of the rack in the transverse direction.

The support frame may, for example, comprise a pair of support arms extending from the rack, the arms having ball-shaped ends, and the mounting means may comprise socket members attached to the table frame to releasably receive the ball-shaped ends of the arms in a manner providing the required pivotal movement of the rack.

Additional features of the invention include, for example, a facility whereby the length of the support arms may be adjusted, so that the attachment may be adapted for use on different length tables, the provision of a spring bumper or compressor internally of the rack, for applying pressure against the racked complement of playing items so as to provide compaction thereof, and the provision of a pad on the base of the rack at the distal end thereof which contacts the table surface while the playing items are being racked, so that the rack itself is clear of the table surface thereby reducing wear and the risk of damage to the surface.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Figure 1:
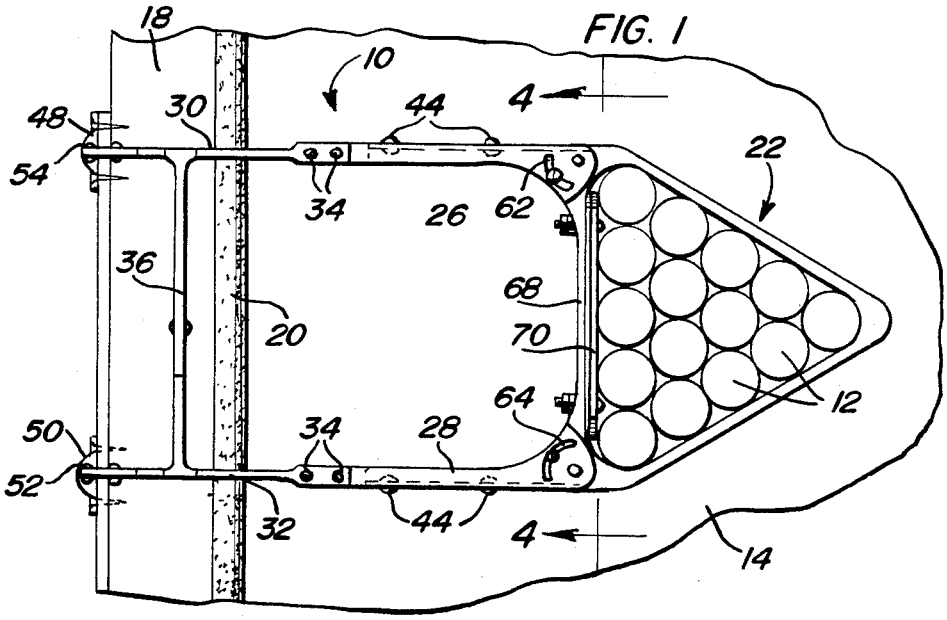
FIG. 1 is a plan view of a rack for table games in accordance with the invention shown in operative position on a pool table.

The drawings illustrate a rack attachment 10 for use in properly locating and orienting pool balls 12 on the playing surface 14 of a pool table prior to commencement of a game of pool. The table has a conventional peripheral surround 18 with an interior cushion 20.

Figure 3:
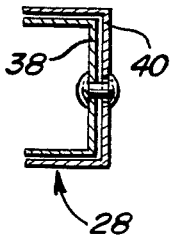
FIG. 3 is a sectional view on line 3—3 of FIG. 2 through one of the rack support frame members.
Figure 2:
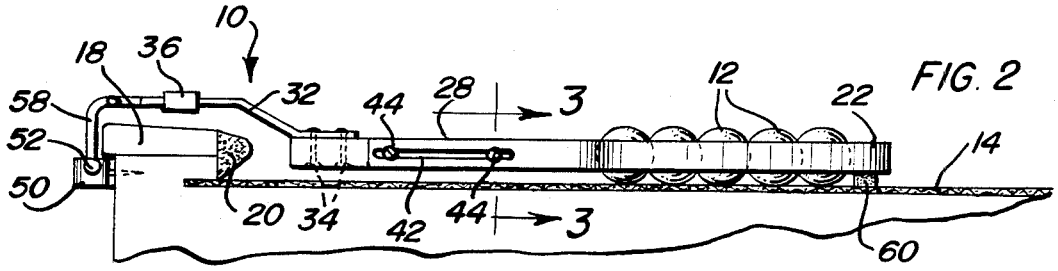
FIG. 2 is a side elevational view of the rack as shown in FIG. 1.
Figure 5:
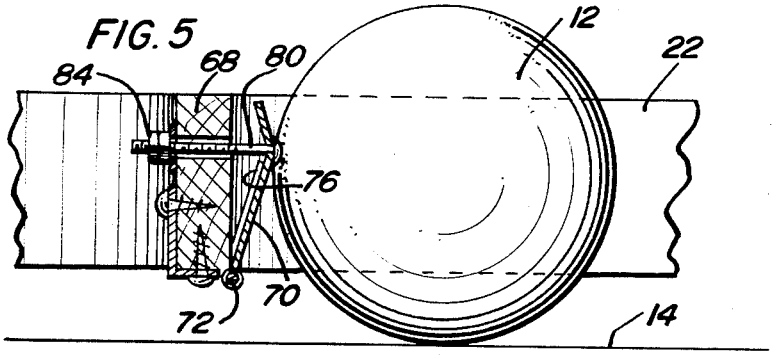
FIG. 5 is a sectional view on line 5—5 of FIG. 4.

Attachment 10 comprises a triangular-shaped rack 22 shaped to receive the normal complement of fifteen pool balls, and a support frame attached to the rack. The frame includes forward telescopic arm portions 26, 28, rearward arm portions 30, 32 secured by screws 34 or the like to the forward arm portions, and a stabilizing crossbar 36. Each forward arm portion includes inner and outer channel sections, such as 38 and 40, as shown in FIG. 3, which are longitudinally slotted at 42 (FIG. 2) and have tightening nuts 44 or the like enabling the sections to be adjusted longitudinally and set to length to fix the overall length of attachment 10 to suit different length pool tables. Rearward arm portions 30, 32 are profiled to extend over the table surround 18. To the outer face of the table surround are secured a pair of ball-receiving sockets 48, 50 for releasably receiving the ends 52, 54 of the respective rearward arm portions 30, 32, which ends are formed as ball-shaped members for specific receipt in the sockets so that the entire attachment 10 can pivot about a horizontal axis defined by the sockets. The rearward arm portions 30, 32 have vertical terminal sections such as 58 (FIG. 2). The height of sections 58 along with the level at which the sockets 48, 50 are secured to the surround 18 (by screws or the like) are such that the horizontal axis about which the attachment pivots closely conforms with the horizontal plane containing the equators of balls 12.

A pad 60 of soft rubber or like resilient material is provided under the apex of rack 22 to rest on the table surface 14, and the rack may be secured to the forward arm portions 26, 28 by swivel connectors 62, 64 allowing the angular alignment of the rack relative to the support frame to be adjusted.

Rear panel 68 of the rack includes an internal bumper or compressor plate 70 pivotally attached to the rack along its lower end by hinges 72, 74. Plate 70 is urged inwardly by hairpin springs 76, 78, and restraining bolts 80, 82 secured by nuts 84 extend through suitable openings in the plate and panel 68. Compressor plate 70 serves to apply pressure against the complement of balls 12 when racked to aid in compacting the balls thereby achieving a tight rack of balls. The tension of the compressor plate can be adjusted by means of the nuts 84. The rack and support frame structure may be manufactured in any suitable materials, such as wood, metal and plastic, or combinations of these.

In use, sockets 48 and 50 are secured to the outer surface of the table surround in locations fixing the lateral alignment of rack 22 in relation to the marked spot on the table surface, and the length of the support arm portions 26, 28 is set to suit the particular length of the table. The alignment of rack 22 may also be fixed by means of swivel connectors 62, 64. When racking of the pool balls is required, the ball-shaped ends 52, 54 of the frame support arms are positioned in the sockets and the rack is swivelled down into position on the table surface. After the balls have been racked, the entire rack and frame structure can be pivoted upwardly about the ball-and-socket connections, with the location of the balls being undisturbed due to the horizontal disposition of the swivel axis being in close proximity to the plane of the ball equators. When raised, the attachment can be removed from the sockets 48, 50.

Figure 6:
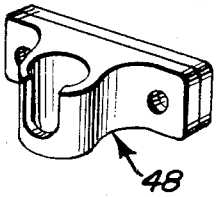
FIGS. 6 and 7 are perspective views of alternative forms of mounting socket for releasably attaching the rack to a table surround.
Figure 7:
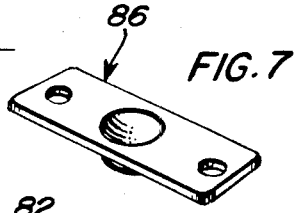
Figure 4:
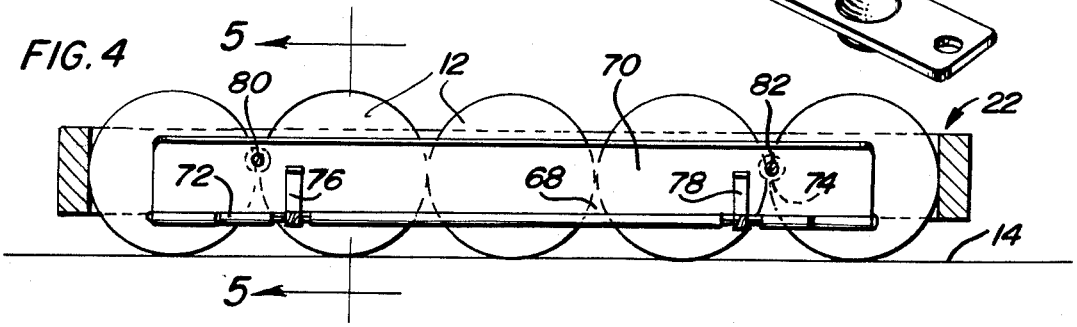
FIG. 4 is a sectional view on line 4—4 of FIG. 1.

In place of the sockets 48, 50 shown in FIGS. 2 and 6, which attach to the outer surface of table surround 18, sockets such as socket 86 shown in FIG. 7 can be used, such sockets being countersunk into the top surface of the table surround. The profiles of the rearward arm portions 30, 32 of the attachment support frame are suitably modified for use with this type of socket.

In a further application of the invention, the attachment may be adapted to the placement of bowling pins on the surface of a miniature tenpin bowling table. In this form of the invention, for example, rack 22 may comprise a board or the like having appropriately positioned holes therein for receipt of the respective bowling pins. Also, in this case, the attachment may be adapted for mounting internally of the pin pit and the frame support arms may be of fixed length.

It will be seen from the foregoing that the invention provides a useful attachment for pool tables and the like, which is simple to use and which eliminates human error in accurately placing playing pieces on a game playing surface of the table. Further, by provision of the resilient pad under the apex of the attachment, possibly injurious contact between the attachment and the playing surface is avoided. The compressor plate aids in the provision of a tight rack of balls in contradistinction to conventional racks where a degree of clearance is generally provided, and complete compaction of the balls must be accomplished by hand.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An attachment for use on a conventional pool table for the placement of game playing pieces such as pool balls in required location and orientation on the surface of the table, the attachment comprising a rack of specified shape for receiving a complement of the playing pieces and orienting the complement in a required configuration, a support frame extending from the rack, and mounting means for mounting the frame detachably and pivotally on the table surround for pivotal movement of the rack about a horizontal axis between a lowered operative position in which the rack is supported on the playing surface for placement of the playing pieces, and a raised inoperative position for detachment of the rack from the table after placement of playing pieces, the length of the support frame effectively fixing the position of the rack relative to the table in a longitudinal direction and the location of the mounting means relative to the table surround effectively fixing the position of the rack in the transverse direction, wherein the support frame comprises support arms extending from the rack, the support arms having telescopic portions for adjusting the length of the support frame to suit the length of a table with which the attachment is used, adjustable swivel connections between the rack and the respective arms for adjusting the angular alignment of the entire rack relative to the support frame and wherein the mounting means comprises a ball-shaped member at the end of each arm and a corresponding socket member for attachment to the table surround to receive and releasably locate the ball-shaped member.

2. The invention of claim 1 including a support member of relatively soft material connected under a distal end of the rack for supporting the rack in operative position on the surface of the table with the rack and support frame being clear of the surface.

3. The invention of claim 1 wherein the support frame comprises support arms extending from the rack and the mounting means comprises ball-shaped members provided on the ends of said arms and socket members for attachment to the table surround to releasably and pivotally receive the ball-shaped members.

4. The invention of claim 3 wherein the socket members are adapted for mounting on an outer surface of the table surround.

5. The invention of claim 3 wherein the socket members are adapted for mounting on an upper surface of the table surround.

6. The invention of claim 1 including pressure means associated with the rack for applying compacting pressure against a complement of playing pieces placed in the rack.

7. An attachment for use on a conventional pool table for the placement of game playing pieces such as pool balls, in required location and orientation on the surface of a playing table the attachment comprising a rack of specified shape for receiving a complement of the playing pieces and orienting the complement in a required configuration, a support frame extending from the rack, and mounting means for mounting the frame detachably and pivotally on the table surround for pivotal movement of the rack about a horizontal axis between a lowered operative position in which the rack is supported on the playing surface for placement of the playing pieces, and a raised inoperative position in which the rack may be removed from the table, the length of the support frame effectively fixing the position of the rack relative to the table in a longitudinal direction and the location of the mounting means relative to the table surround effectively fixing the position of the rack in the transverse direction, the attachment including means for adjusting the angular alignment of the entire rack relative to the support frame.

8. The invention of claim 7 wherein the support frame comprises support arms and the adjusting means comprises swivel connectors between the rack and the respective support arms.

9. In combination with a conventional pool game playing table, an attachment for use in locating and orienting game playing pieces, such as pool balls, in specified position and orientation on the table surface, the attachment comprising a rack for receiving a complement of playing pieces and orienting the complement in a required configuration, a support frame extending from the rack, and mounting means for pivotally mounting the frame on the table surround with the pivot axis of the frame being situated in a horizontal plane for enabling the rack to be pivotally raised from an operative position in which it is supported on the playing surface without longitudinal displacement of the playing pieces, the length of the support frame effectively fixing the position of the rack lengthwise of the table and the location of the mounting means relative to the surround effectively fixing the position of the rack transversely of the table wherein the support frame comprises support arms extending from the rack and terminating in ball-shaped ends, and wherein the means associated with the table surround comprises socket members for releasably and pivotally receiving the ball-shaped ends of said arms for detachment of the attachment from the table when the rack is raised from the operative position.

10. The invention of claim 9 including a support member of relatively soft material secured under the distal end of the rack for supporting the rack on the playing surface of the table with the rack and support frame clear of the surface.

11. The invention of claim 9 wherein the rack includes means for applying compacting pressure on a complement of playing pieces received therein.

12. The invention of claim 11 wherein the pressure applying means comprises a pressure plate extending along an internal wall of the rack, and resilient biasing means urging the plate toward the interior of the rack.

13. The invention of claim 12 wherein the plate is pivotally secured along one edge thereof to the interior wall of the rack.

14. The invention of claim 13 wherein the resilient biasing means comprises at least one hairpin spring interposed between the plate and said wall of the rack.

15. The invention of claim 14 including means for adjusting the tension of the biasing means.

16. The invention of claim 15 including a retention bolt extending through openings in the plate and the rack respectively, the tension adjusting means comprising a nut threaded onto the bolt.

* * * * *